US010054897B2

(12) United States Patent
Kuroki et al.

(10) Patent No.: US 10,054,897 B2
(45) Date of Patent: Aug. 21, 2018

(54) IMAGE FORMATION APPARATUS WITH POST-PROCESSING

(71) Applicant: KYOCERA Document Solutions Inc., Osaka-shi, Osaka (JP)

(72) Inventors: Hirofumi Kuroki, Osaka (JP); Mikiya Kitagawa, Osaka (JP); Seiichi Shirasaki, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/543,529

(22) PCT Filed: Mar. 30, 2016

(86) PCT No.: PCT/JP2016/060427
§ 371 (c)(1),
(2) Date: Jul. 13, 2017

(87) PCT Pub. No.: WO2016/159097
PCT Pub. Date: Oct. 6, 2016

(65) Prior Publication Data

US 2018/0011440 A1 Jan. 11, 2018

(30) Foreign Application Priority Data

Mar. 31, 2015 (JP) ..... 2015-072797

(51) Int. Cl.
*G03G 21/16* (2006.01)
*G03G 15/00* (2006.01)

(52) U.S. Cl.
CPC ..... *G03G 21/1609* (2013.01); *G03G 15/5016* (2013.01); *G03G 15/6541* (2013.01); *G03G 21/1633* (2013.01)

(58) Field of Classification Search
CPC ..... G03G 21/1609; G03G 21/1642; G03G 21/1604
See application file for complete search history.

(56) References Cited

U.S. PATENT DOCUMENTS

2007/0166068 A1* 7/2007 Kurokawa ..... G03G 15/5016 399/81
2009/0148210 A1 6/2009 Takenaka

FOREIGN PATENT DOCUMENTS

JP 2009137754 A 6/2009

* cited by examiner

*Primary Examiner* — Victor Verbitsky
(74) *Attorney, Agent, or Firm* — Alleman Hall Creasman & Tuttle LLP

(57) ABSTRACT

The image reading unit (2) reads an image from a document. The image forming unit (3) is located below the image reading unit (2) and forms an image on a sheet. The operation unit (5) is rotatably supported at a position forward of the image reading unit (2) and receives user's operation. The post-process unit (7) is provided between the image reading unit (2) and the image forming unit (3), and has, at a position interfering with the rotation range of the operation unit (5), a retracted portion (772) retracted rearward in the post-process unit (7). The post-process unit (7) performs a post-process on a sheet on which an image has been formed by the image forming unit (3).

4 Claims, 5 Drawing Sheets

IMAGE FORMATION APPARATUS WITH POST-PROCESSING

TECHNICAL FIELD

The present invention relates to an image formation apparatus having a post-process portion capable of executing a post-process such as a stapling process.

BACKGROUND ART

In general, there is known an image formation apparatus of in-body discharge type in which a sheet having an image formed thereon is discharged to an in-body discharge unit between an image reading unit and an image forming unit. In addition, a post-process unit capable of executing a post-process such as a stapling process may be provided to the in-body discharge portion of this type of image formation apparatus (see, for example, Patent Literature 1).

CITATION LIST

Patent Literature

[PTL 1] Japanese Laid-Open Patent Publication No. 2009-137754

SUMMARY OF THE INVENTION

Problems to be Solved by the Invention

In such an image formation apparatus, an operation unit for receiving user's operation may be rotatably provided. In this case, in the image formation apparatus in which the post-process unit is mounted to the in-body discharge unit, if the operation unit and the post-process unit are separated from each other in the front-rear direction or the right-left direction so that the post-process unit does not interfere with the rotation range of the operation unit, there is a problem that size reduction of the image formation apparatus is hindered.

An object of the present invention is to achieve size reduction of an image formation apparatus including a post-process unit mounted to an in-body discharge unit, and a rotatable operation unit.

Solution to the Problems

An image formation apparatus according to one aspect of the present invention includes an image reading unit, an image forming unit, a post-process unit, and an operation unit. The image reading unit is configured to read an image from a document. The image forming unit is located below the image reading unit and configured to form an image on a sheet. The operation unit is rotatably supported at a position forward of the image reading unit and configured to receive user's operation. The post-process unit is provided between the image reading unit and the image forming unit and has, at a position interfering with a rotation range of the operation unit, a retracted portion retracted rearward in the post-process unit. The post-process unit is configured to perform a post-process on a sheet on which an image has been formed by the image forming unit.

Advantageous Effects of the Invention

The present invention can achieve size reduction of the image formation apparatus including the post-process unit mounted to the in-body discharge unit, and the rotatable operation unit.

DESCRIPTION OF EMBODIMENTS

Figure 1:
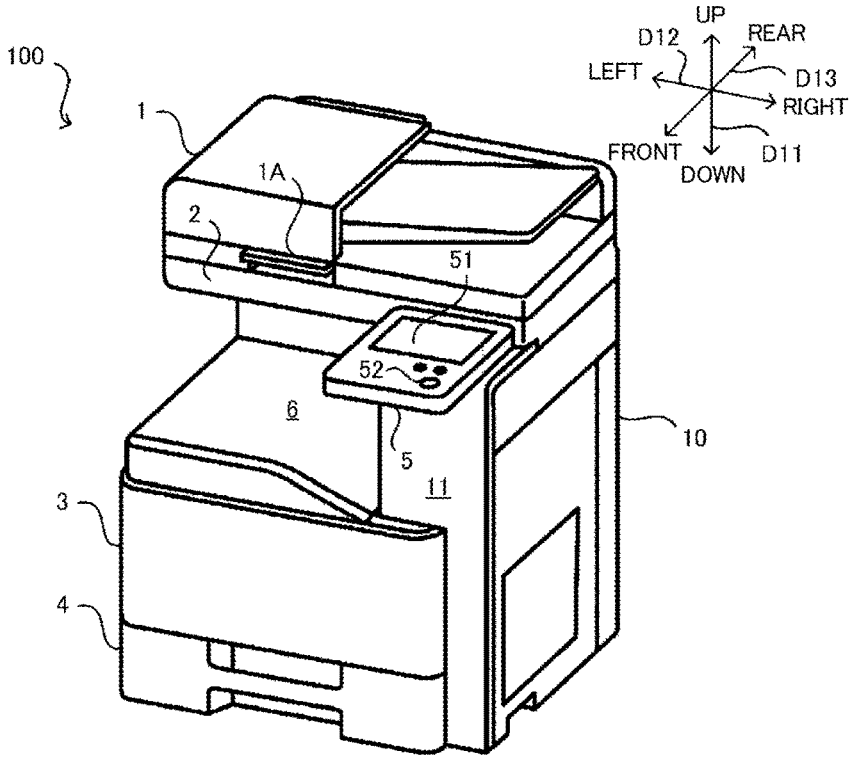
FIG. 1 is a perspective view of an image processing apparatus according to an embodiment of the present invention.

Hereinafter, with reference to the accompanying drawings, embodiments of the present invention will be described for understanding of the present invention. The following embodiments are merely examples embodying the present invention, and are not intended to limit the technical scope of the present invention.

[Schematic Configuration of Image Formation Apparatus 100]

First, with reference to FIG. 1 to FIG. 4, a schematic configuration of an image formation apparatus 100 according to an embodiment of the present invention will be described. The image formation apparatus 100 is a multi-function peripheral having a plurality of functions such as a scanning function, a print function, a facsimile function, and a copy function. In the following description, an up-down direction D11, a right-left direction D12, and a front-rear direction D13 shown in the drawings are used as necessary.

Figure 2:
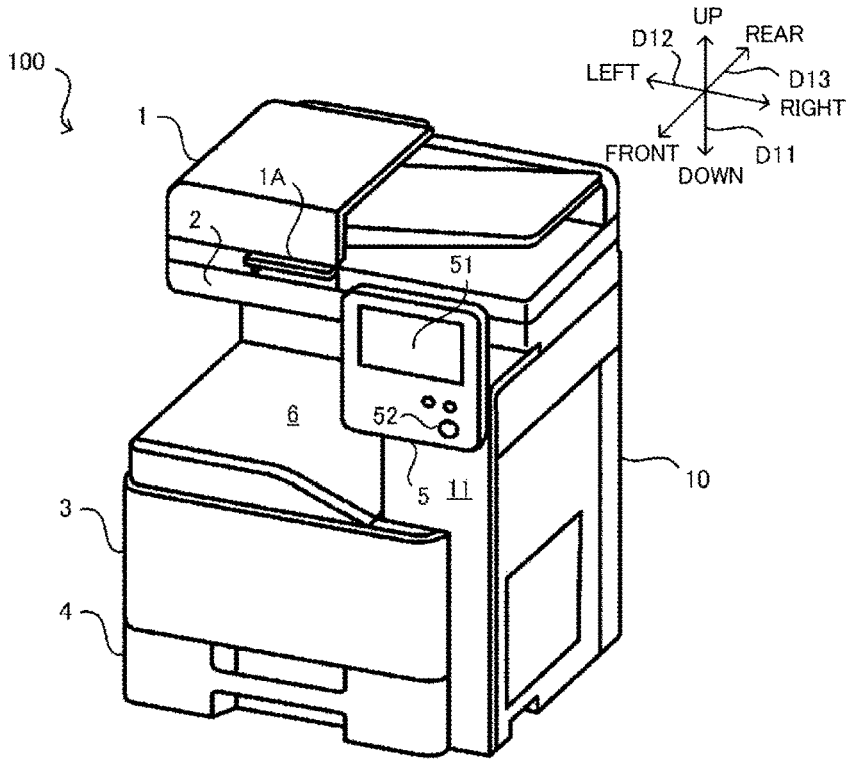
FIG. 2 is a perspective view of the image processing apparatus according to the embodiment of the present invention.
Figure 3:
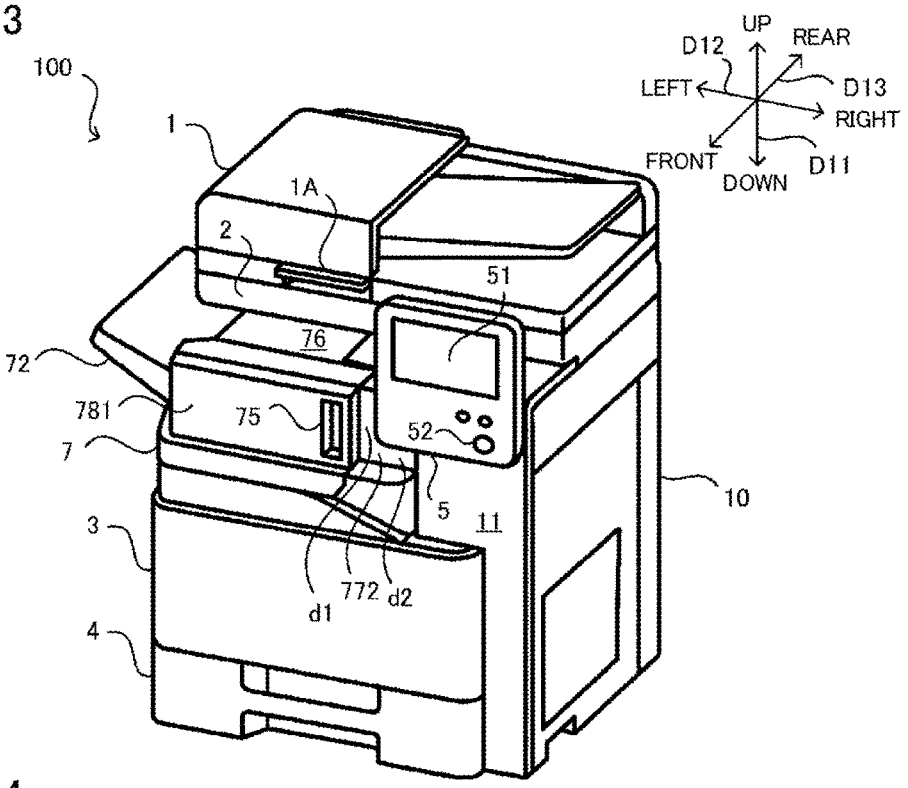
FIG. 3 is a perspective view of the image processing apparatus according to the embodiment of the present invention.
Figure 4:
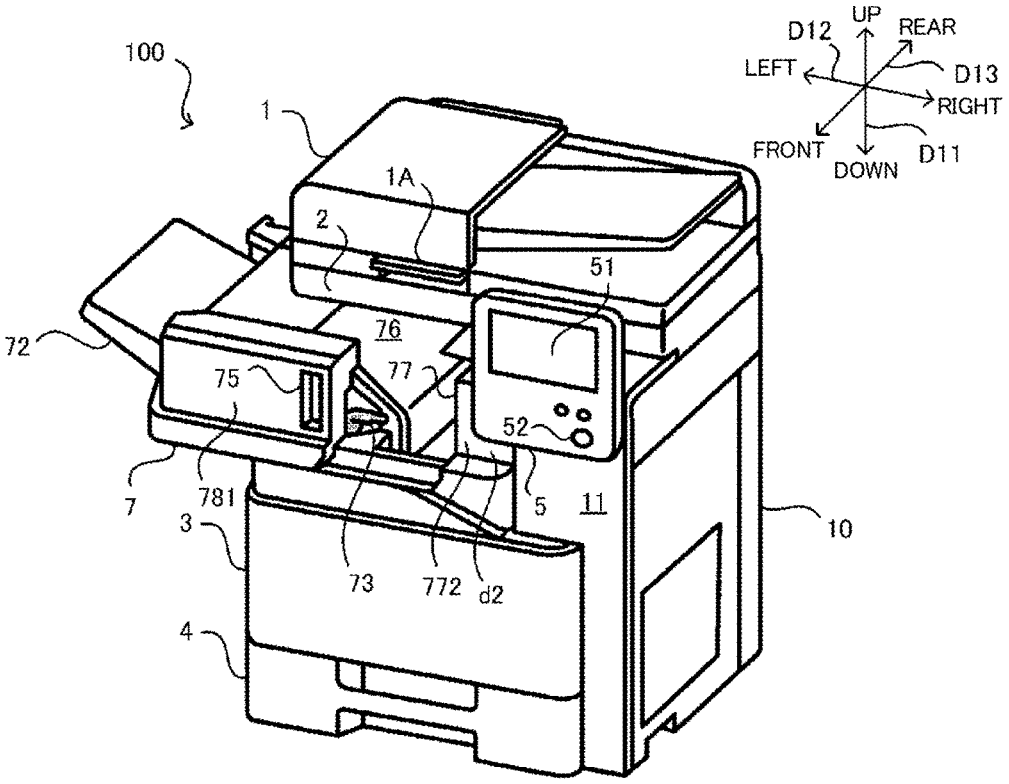
FIG. 4 is a perspective view of the image processing apparatus according to the embodiment of the present invention.

The image formation apparatus 100 includes an ADF 1, an image reading unit 2, an image forming unit 3, a sheet feed cassette 4, an operation unit 5, an in-body discharge unit 6, a post-process unit 7, a support housing 10, and the like. The post-process unit 7 is an option unit mountable to and detachable from the in-body discharge unit 6 of the image formation apparatus 100. Here, FIG. 1 and FIG. 2 are views showing a state before the post-process unit 7 is mounted, and FIG. 3 and FIG. 4 are views showing a state in which the post-process unit 7 is mounted.

The ADF 1 is an automatic document feeder which includes a document set portion, a conveyance roller, a document holder, and a sheet discharge portion, and conveys a document to be read by the image reading unit 2. The image reading unit 2 includes a document table, a light source, a mirror, an optical lens, and a CCD (Charge Coupled Device), and is capable of reading an image from a document and outputting the read image as image data. The ADF 1 is openable and closable with respect to the image reading unit 2, and a grip portion 1A used for user's operation of opening or closing the ADF 1 is provided to the ADF 1.

The image forming unit 3 is located below the image reading unit 2. The image forming unit 3 is an electrophotographic-type image forming unit that forms an image on a sheet fed from the sheet feed cassette 4 storing sheets, on the basis of image data read by the image reading unit 2 or image data inputted from an external information processing apparatus. Specifically, the image forming unit 3 includes a photosensitive drum, a charging device, a laser scanning unit (LSU), a developing device, a transfer roller, a cleaning device, a fixing roller, and the like.

In the image formation apparatus 100, the image forming unit 3 is housed in the support housing 10, and the sheet feed cassette 4 is mountable to and detachable from the support housing 10. The image reading unit 2 is supported above the support housing 10.

The operation unit 5 includes: a touch panel 51 which displays various information such as an operation screen and receives user's operation; and a hardware key 52 such as a start key. The operation portion 5 is rotatably supported at a position frontward of the image reading portion 2 by a front surface panel 11 of the support housing 10.

Specifically, the operation unit 5 is rotatable between a first position (see FIG. 2 to FIG. 4) in which the surface of the operation unit 5 (surface of touch panel 51) is parallel to the vertical plane, and a second position (see FIG. 1) in which the surface of the operation unit 5 is parallel to the horizontal plane. In addition, the operation unit 5 can keep its posture at any position between the first position and the second position.

The first attitude and the second attitude are not limited to the above case. For example, the first position may be a state in which the surface of the operation unit 5 is slightly inclined with respect to the vertical plane, or may be a state in which the surface of the operation unit 5 is inclined by, for example, about 15 degrees with respect to the vertical plane. Similarly, the second position may be a state in which the surface of the operation unit 5 is slightly inclined with respect to the horizontal plane, or may be a state in which the surface of the operation unit 5 is inclined by, for example, about 15 degrees with respect to the horizontal plane.

The width of the operation unit 5 in the right-left direction D12 is greater than the width of the front surface panel 11 in the right-left direction D12, so that a part of the operation unit 5 protrudes leftward relative to the front surface panel 11. When the operation unit 5 is in the first position, the surface of the operation unit 5 is located on the same plane as the front end surfaces of the image forming unit 3 and the post-process unit 7, or located rearward relative to the front end surfaces of the image forming unit 3 and the post-process unit 7. When the operation unit 5 is in the second position, the surface of the operation unit 5 is located on the same plane as the upper surface of the image reading unit 2, or located downward relative to the upper surface of the image reading unit 2.

The in-body discharge unit 6 is located between the image reading unit 2 and the image forming unit 3 in the vertical direction. When the post-process unit 7 is not mounted to the in-body discharge unit 6, a sheet on which an image has been formed by the image forming unit 3 is discharged to the in-body discharge unit 6. On the other hand, when the post-process unit 7 is mounted to the in-body discharge unit 6, a sheet on which an image has been formed by the image forming unit 3 is conveyed to the post-process unit 7.

[Configuration of Post-Process Unit 7]

Figure 5:
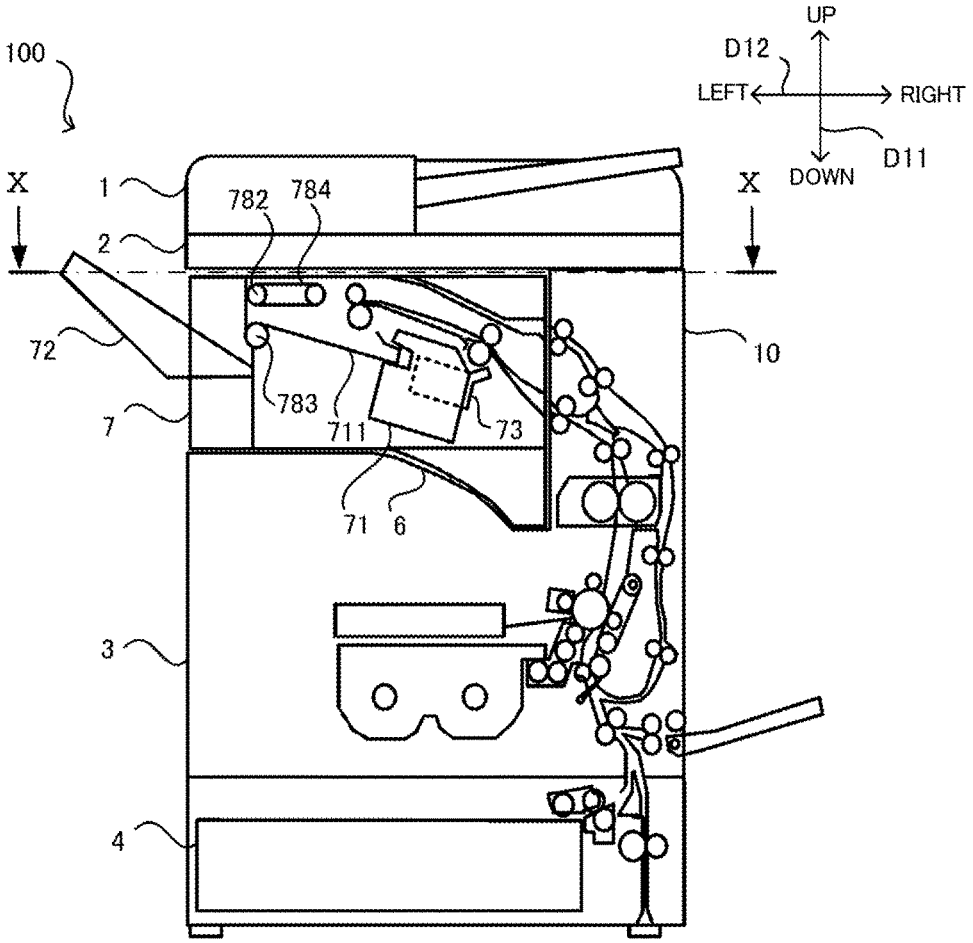
FIG. 5 is a schematic front view of the internal configuration of the image processing apparatus according to the embodiment of the present invention.
Figure 6:
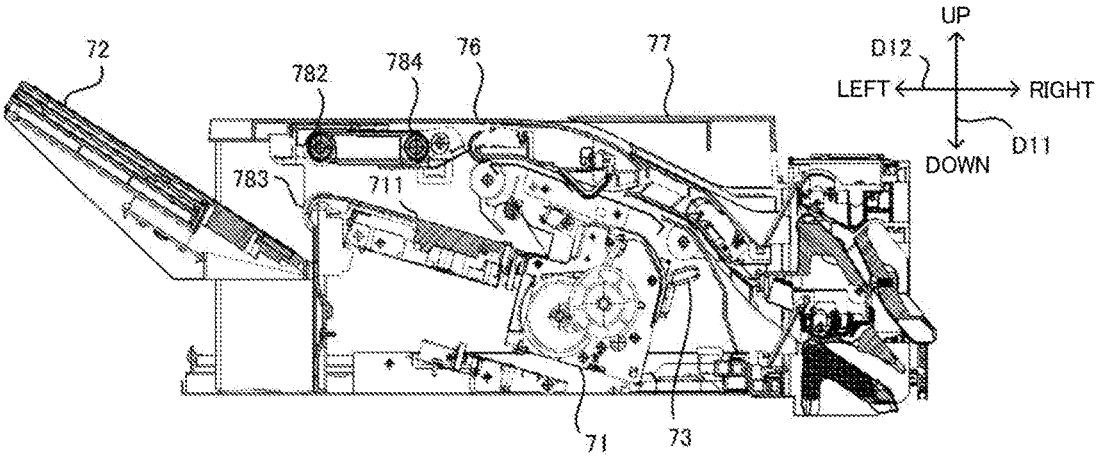
FIG. 6 is a schematic front view showing the internal configuration of a post-process portion of the image processing apparatus according to the embodiment of the present invention.
Figure 7:
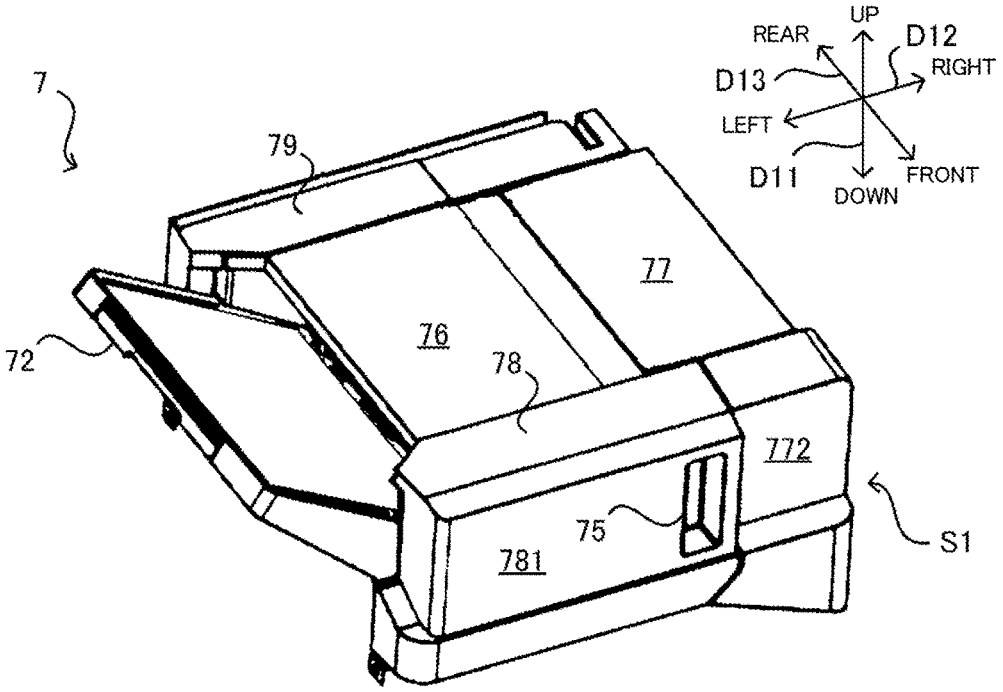
FIG. 7 is a perspective view showing the post-process portion of the image processing apparatus according to the embodiment of the present invention.
Figure 8:
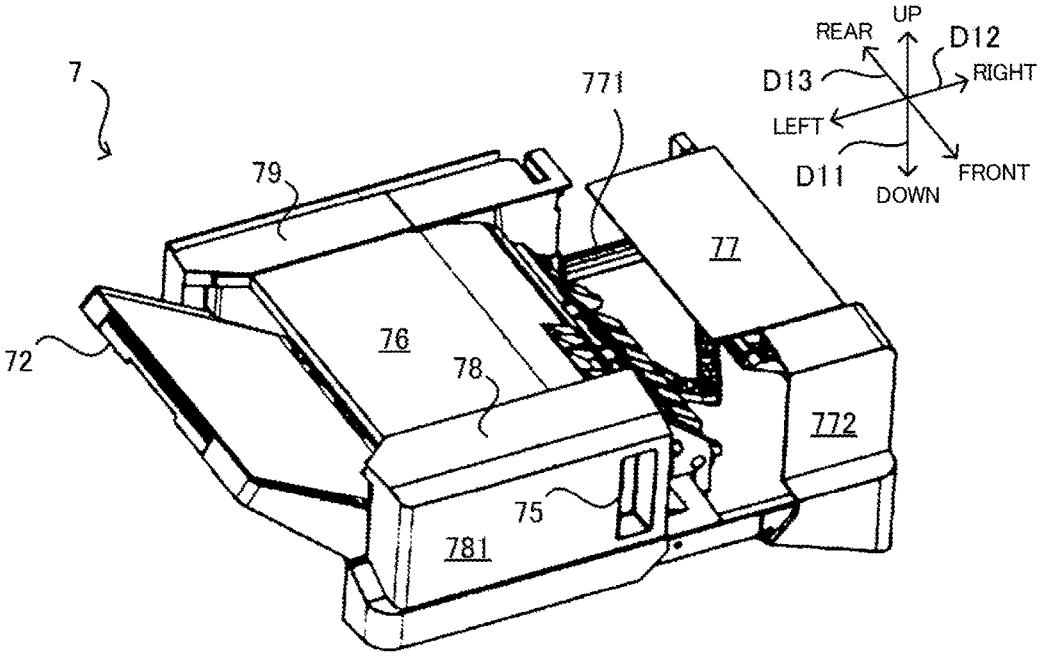
FIG. 8 is a perspective view showing the post-process unit of the image processing apparatus according to the embodiment of the present invention.
Figure 9:
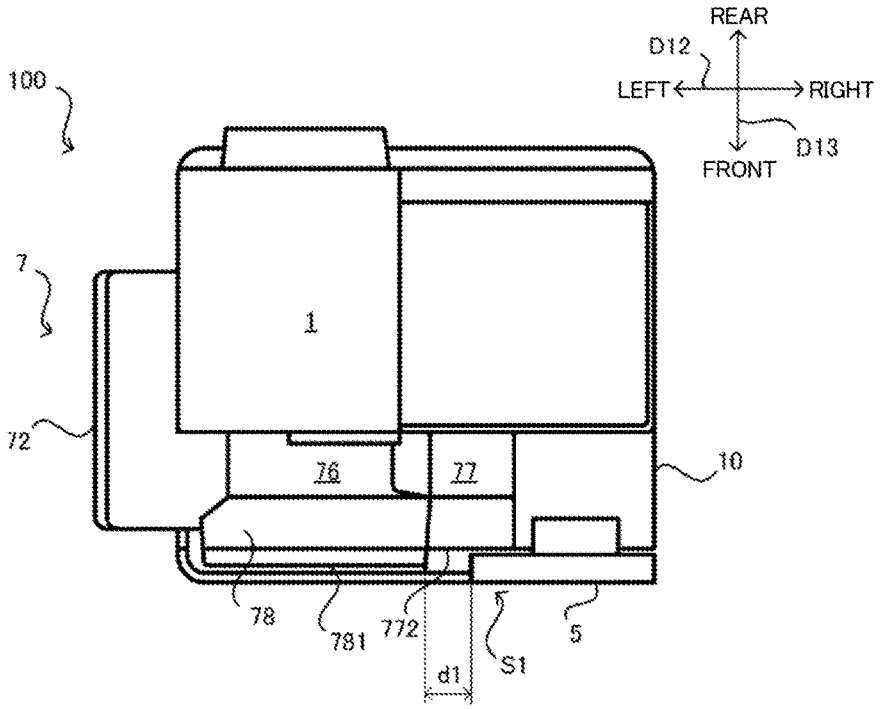
FIG. 9 is a plan view of the image processing apparatus according to the embodiment of the present invention.
Figure 10:
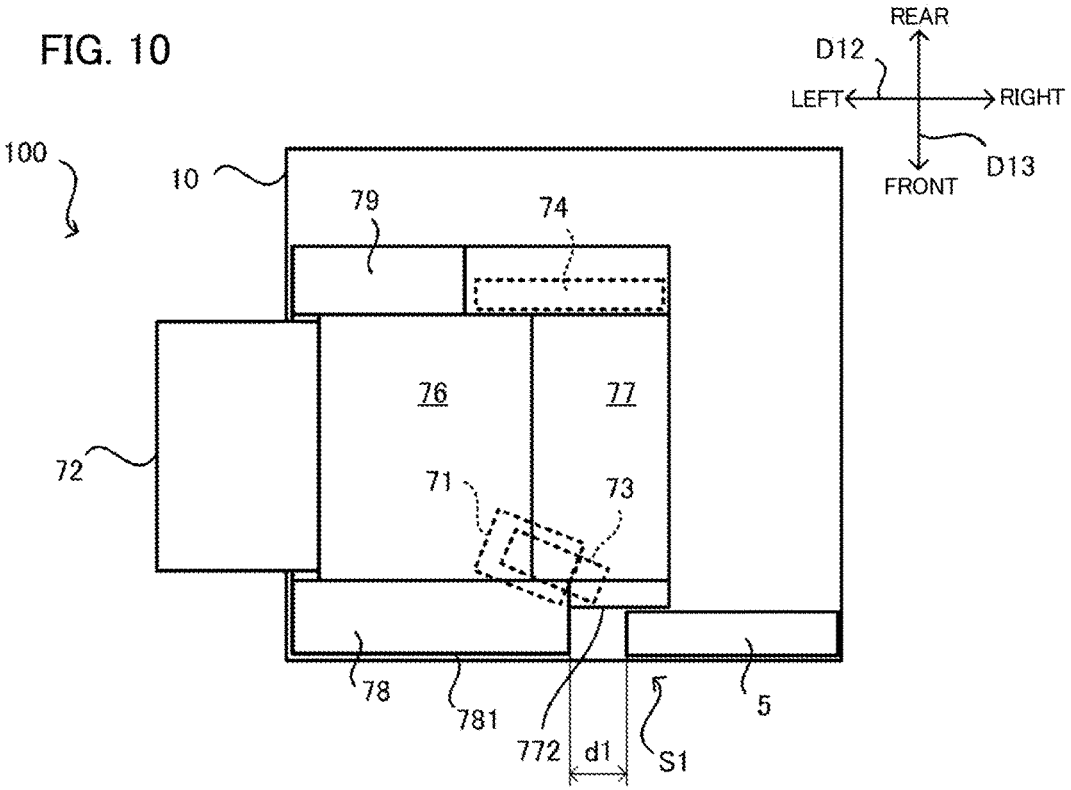
FIG. 10 is a view as seen from the direction of arrows X-X in FIG. 5.

Next, with reference to FIG. 3 to FIG. 10, the configuration of the post-process unit 7 will be described. FIG. 5 is a schematic view showing the internal configuration of the image formation apparatus 100, and FIG. 6 is a schematic view showing the internal configuration of the post-process unit 7. FIG. 7 and FIG. 8 are perspective views of the post-process unit 7, and FIG. 9 is a plan view of the image formation apparatus 100. FIG. 10 is a view as seen from the direction of arrows X-X in FIG. 5.

As described above, the post-process unit 7 is mounted to the in-body discharge unit 6, whereby the post-process unit 7 is provided between the image reading unit 2 and the image forming unit 3. The post-process unit 7 is a stapling process unit capable of performing a stapling process on a sheet on which an image has been formed by the image forming unit 3. The post-process unit 7 includes a stapler 71, a sheet discharge tray 72, a staple container 73, a circuit board 74, a grip portion 75, a first unit 76, and a second unit 77.

In the post-process unit 7, a plurality of sheets fed from the image formation apparatus 100 are subjected to a stapling process by the stapler 71, and then a bundle of the sheets bound by a staple is discharged to the sheet discharge tray 72. The post-process unit 7 may be a punching process unit capable of performing a perforation process (punching process) on a sheet, instead of the stapling process.

The staple container 73 is mountable to and detachable from the stapler 71, and stores staples to be used in the stapling process. The stapler 71 performs a stapling process on sheets on which images have been formed by the image forming unit 3, using a staple stored in the staple container 73. The circuit board 74 includes: a power supply board for supplying power from the image formation apparatus 100 to the post-process unit 7; a control board for controlling operation of the post-process unit 7 on the basis of a control command from the image formation apparatus 100; and the like.

As shown in FIG. 7 and FIG. 8, the outer appearance of the post-process unit 7 has substantially a rectangular parallelepiped shape. In the post-process unit 7, via a pair of rails 771 provided to the first unit 76 and the second unit 77 and extending in the right-left direction D12, the first unit 76 is connected with the second unit 77 so as to be able to be separated therefrom and contact therewith. That is, a part of the post-process unit 7 is openable and closable in the right-left direction D12. Although not shown in FIG. 7, the rail 771 is provided also on the front side of the post-process unit 7.

The second unit 77 is a connection unit connected with a portion to which a sheet on which an image has been formed by the image forming unit 3 is discharged. In the post-process unit 7, a sheet conveyance path extending to the sheet discharge tray 72 from a port through which a sheet is discharged to the in-body discharge portion 6 of the image formation apparatus 100 is formed across the first unit 76 and the second unit 77.

On the other hand, on the first unit 76 side, the stapler 71, the sheet discharge tray 72, the staple container 73, the circuit board 74, the grip portion 75, a first drive portion 78, and a second drive portion 79 are provided. In the first drive portion 78 and the second drive portion 79, various drive motors, drive gears, and the like are provided which are used for rotation of a sheet conveyance roller, lifting and lowering of the sheet discharge tray 72, movement of the stapler 71, or the like in the post-process unit 7, for example. Therefore, the length of the post-process unit 7 in the front-rear direction D13 needs to have a dimension obtained by adding the length of the first drive portion 78 and the second drive portion 79 in the front-rear direction D13, to the length, of the maximum-size sheet that can be used in the image formation apparatus 100, in a width direction perpendicular to the sheet conveyance direction.

Specifically, as shown in FIG. 5 and FIG. 6, in the first unit 76, a sheet tray 711, a pair of conveyance rollers 782, 783, a separation/contact mechanism 784, and the like are provided. On the sheet tray 711, sheets to be processed by the stapler 71 are placed. The conveyance roller 782 is connected with the drive motor provided in the first drive portion 78. The separation/contact mechanism 784 is connected with the drive motor provided in the second drive portion 79, and is a mechanism for causing the conveyance roller 782 to be separated from or contact with the conveyance roller 783. The conveyance roller 783 is driven by the conveyance roller 782 being driven while the conveyance roller 783 is in contact with the conveyance roller 782.

In the post-process unit 7, a sheet fed from the upstream side in the sheet conveyance direction is placed on the sheet tray 711, and then the conveyance roller 782 is moved downward by the separation/contact mechanism 784, to nip the sheet between the conveyance roller 782 and the conveyance roller 783. Then, by the conveyance roller 782 being driven, the sheet on the sheet tray 711 is conveyed to a stapling position of the stapler 71, and a stapling process by the stapler 71 is executed. Thereafter, a bundle of sheets placed on the sheet tray 711 after the stapling process are discharged to the sheet discharge tray 72.

In the first unit 76, the grip portion 75 is provided at an end portion on the operation unit 5 side in the right-left direction D12 of the image formation apparatus 100, and is used for opening and closing the first unit 76 in the post-process unit 7. The grip portion 75 is a recess provided in a front surface 781 of the first drive portion 78. This enables a user to slide the first unit 76 in the right-left direction D12 by gripping the grip portion 75, to open or close the first unit 76 with respect to the second unit 77. In addition, since the grip portion 75 is located near the operation unit 5 side, the grip portion 75 is likely to come in sight of a user at the time of operating the operation unit 5, whereby presence of the grip portion 75 can be easily recognized by the user.

When the first unit 76 is separated from the second unit 77, a gap is formed between the first unit 76 and the second unit 77, so that a part of the sheet conveyance path in the post-process unit 7 is exposed and it becomes possible to extract the staple container 73. For example, when a jam occurs so that a sheet jams in the post-process unit 7, or when the staple container 73 is to be refilled with staples, the first unit 76 is opened or closed by a user.

In the image formation apparatus 100, when the operation unit 5 is in the first attitude, the lower left end of the operation unit 5 is at a position above the in-body discharge unit 6, that is, at a position where the post-process unit 7 is mounted. In this case, if the image formation apparatus 100 is configured such that the operation unit 5 and the post-process unit 7 are separated from each other so as to prevent the post-process unit 7 from interfering with the rotation range of the operation unit 5, there is a problem that size reduction of the image formation apparatus 100 is hindered. On the other hand, the image formation apparatus 100 according to the present embodiment enables size reduction of the image formation apparatus 100 while avoiding interference between the rotatable operation portion 5 and the post-process unit 7 mounted to the in-body discharge unit 6.

Specifically, in the post-process unit 7, the first drive portion 78 and the second drive portion 79 are provided to the first unit 76 on the downstream side in the sheet conveyance direction. In addition, in the post-process unit 7, the circuit board 74 is provided rearward of the first unit 76. Therefore, in the post-process unit 7, a region needed on the front side of the second unit 77 is small.

Further, in the image formation apparatus 100, a retracted portion 772 is provided at a position that is on the front side of the second unit 77 of the post-process unit 7 and that interferes with the rotation range of the operation unit 5. The retracted portion 772 is retracted rearward in the post-process unit relative to a surface 781 of the first drive portion 78 of the first unit 76, which is the front end surface of the post-process unit 7. In other words, between the front surface 781 and the retracted portion 772, a step in the front-rear direction D13 is provided which is set in advance so as to at least avoid interference with the rotation range of the operation unit 5.

Thus, as shown in FIG. 9 and FIG. 10, in a plan view of the image formation apparatus 100, a part of the operation unit 5 in the first attitude falls within a retraction space S1 formed with the first drive portion 78 by the retracted portion 772. That is, when the operation unit 5 is rotated, a part of the operation unit 5 could interfere with a circumscribed rectangular region of the post-process unit 7 in a plan view, but at this time, contact between the part of the operation unit 5 and the post-process unit 7 is avoided owing to the retraction space S1 formed by the retracted portion 772. Therefore, in the image formation apparatus 100, the post-process unit 7 and the operation unit 5 can be arranged at positions overlapping each other in the front-rear direction D13 of the image formation apparatus 100.

Therefore, the image formation apparatus 100 enables size reduction in the front-rear direction D13 of the image formation apparatus 100, as compared to the case where the operation unit 5 is provided at a position separated forward from the post-process unit 7 in order to avoid interference between the operation unit 5 and the post-process unit 7, for example. In addition, the image formation apparatus 100 enables size reduction in the right-left direction D12 of the image formation apparatus 100, as compared to the case where the operation unit 5 and the post-process unit 7 are separated from each other in the right-left direction D12 in order to avoid interference between the operation unit 5 and the post-process unit 7.

In addition, as shown in FIG. 3, FIG. 9, and FIG. 10, in the right-left direction D12 and the up-down direction D11 of the image formation apparatus 100, predetermined gaps d1 and d2 are provided between the post-process unit 7 and the operation unit 5. Therefore, a user can separate the first unit 76 from the second unit 77 by inserting the hand into the gap d1 and catching the step between the first unit 76 and the second unit 77. In addition, a user can perform operation to rotate the operation unit 5 by inserting the hand into the gap d1 and gripping the left side surface of the operation unit 5. Further, a user can also perform operation to rotate the operation unit 5 by inserting the hand into the gap d2 and gripping the lower surface or the lower left corner of the operation unit 5.

The invention claimed is:

1. An image formation apparatus comprising:

an image reading unit configured to read an image from a document;

an image forming unit located below the image reading unit and configured to form an image on a sheet;

an operation unit rotatably supported at a position forward of the image reading unit and configured to receive user's operation; and a post-process unit provided between the image reading unit and the image forming unit and having, at a position interfering with a rotation range of the operation unit, a retracted portion retracted rearward in the post-process unit, the post-process unit including a stapler to perform a stapling process on a sheet on which an image has been formed by the image forming unit.

2. The image formation apparatus according to claim 1, wherein when a rotation state of the operation unit is a state in which a surface of the operation unit is parallel to a vertical plane, the surface of the operation unit is present on the same plane as front end surfaces of the image formation apparatus and the post-process unit, or present rearward relative to the front end surfaces of the image formation apparatus and the post-process unit.

3. The image formation apparatus according to claim 1, wherein the operation unit is rotatable between a first position in which a surface of the operation unit is parallel to a vertical plane, and a second position in which the surface of the operation unit is parallel to a horizontal plane.

4. The image formation apparatus according to claim 1, wherein a part of the post-process unit is openable and closable in a right-left direction of the image formation apparatus, and the post-process unit includes a grip portion provided at an end portion on the operation unit side in the right-left direction of the image formation apparatus and used for operation to open/close the part of the post-process unit.

* * * * *